US007452238B1

(12) United States Patent
Wu

(10) Patent No.: US 7,452,238 B1
(45) Date of Patent: Nov. 18, 2008

(54) CABLE CONNECTOR ASSEMBLY WITH IMPROVED SPACER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/811,473

(22) Filed: Jun. 11, 2007

(51) Int. Cl.
*H01R 12/24* (2006.01)

(52) U.S. Cl. ..... 439/579; 439/942; 439/606

(58) Field of Classification Search ..... 439/579, 439/942, 606, 578, 497
See application file for complete search history.

(56) References Cited

U.S. PATENT DOCUMENTS 6,443,773 B1 * 9/2002 Korsunsky et al. ..... 439/660
6,695,641 B1 * 2/2004 Lee ..... 439/493
6,790,087 B2 9/2004 Ho
6,802,744 B2 10/2004 Chiang
6,824,426 B1 * 11/2004 Spink, Jr. ..... 439/579
7,223,121 B2 * 5/2007 Moriyama et al. ..... 439/497
2001/0046354 A1 * 11/2001 Nguyen et al. ..... 385/53
2005/0176305 A1 * 8/2005 Wu ..... 439/660
2006/0099836 A1 5/2006 Ho

* cited by examiner

*Primary Examiner*—Gary F. Paumen
(74) *Attorney, Agent, or Firm*—Wei Te Chung

(57) ABSTRACT

A cable connector assembly (100) includes an insulative housing (2) defining a number of passageways (2251, 2261) along a mating direction, a number of contacts (3) received in the passageways of the insulative housing with tail portions (34) thereof exposed beyond the insulative housing, a spacer (4) assembled to the insulative housing and the contacts, and defining a number of receiving channels (403, 404) to receive the tail portions of the contacts, and a cable (5) including a number of conductors (510, 520, 522) respectively electrically connecting with the contacts. At least a pair of tail portions of the contacts is received in the same receiving channel of the spacer with other tail portions of the contacts received in the receiving channels of the spacer in one-to-one manner. The spacer further defines at least one slit communicating with said receiving channel receiving said pair of tail portions. At least one conductor is partially received in the slit to be positioned by the slit and electrically connect with said pair of tail portions of the contacts at the same time.

20 Claims, 8 Drawing Sheets

CABLE CONNECTOR ASSEMBLY WITH IMPROVED SPACER

BACKGROUND OF THE INVENTION

1. Field of the Invention

The present invention generally relates to a cable connector assembly, and more particularly to a cable connector assembly used for high-speed transmission.

2. Description of Related Art

Slimline Serial ATA is a new interface in Serial ATA family, and is used for Slimline optical disk drives of 1.8" and 2.5". A slimline Serial ATA comprises a signal segment in accordance with standard Serial ATA signal interface and a segment comprises two pairs of contacts served as positive and negative poles for 5 v power transmission and two optical contacts for DP (Device Present) and MD (Manufacturing Diagnostic) use. The two pairs of power contacts need to connect with a pair of conductors of a cable. That is to say, two-to-one connection manner is formed. Thus, a spacer is needed to realize such connection. Spacer is a usual element in a cable connector assembly. The main function of a spacer is to align tail portions of contacts received in a housing and conductors of a cable, further provide support to the solder between the tail portions and the conductors. Thus, the spacer comprises a plurality of passageways permitting the tail portions of the contacts laid thereon in one-to-one manner and the conductors of the cable laid on the tail portions in one-to-one manner or two-to-one manner to realize the electrical connection, as disclosed in U.S. Pat. No. 6,790,087 which is assigned to Molex. However, the spacer only realizes the one-to-one connection between the tail portions and the passageways thereof. In slimline Serial ATA, two-to-one connection type is needed. Thus, an improved spacer capable of realizing such connection manner is needed to address the problems above.

BRIEF SUMMARY OF THE INVENTION

Accordingly, an object of the present invention is to provide a cable connector assembly with improved spacer to realize reliable connection between contacts and conductors of cable.

In order to achieve the above-mentioned object, a cable connector assembly in accordance with the present invention comprises an insulative housing defining a plurality of passageways along a mating direction, a plurality of contacts received in the passageways of the insulative housing with tail portions thereof exposed beyond the insulative housing, a spacer assembled to the insulative housing and the contacts, the spacer defining a plurality of receiving channels to receive the tail portions of the contacts, and a cable comprising a plurality of conductors respectively electrically connecting with the contacts. At least a pair of tail portions of the contacts is received in the same receiving channel of the spacer with other tail portions of the contacts received in the receiving channels of the spacer in one-to-one manner. The spacer further defines at least one slit communicating with said receiving channel receiving said pair of tail portions. At least one conductor is partially received in the slit to be positioned by the slit and electrically connect with said pair of tail portions of the contacts at the same time Other objects, advantages and novel features of the invention will become more apparent from the following detailed description of the present embodiment when taken in conjunction with the accompanying drawings.

DETAILED DESCRIPTION OF THE INVENTION

Figure 1:
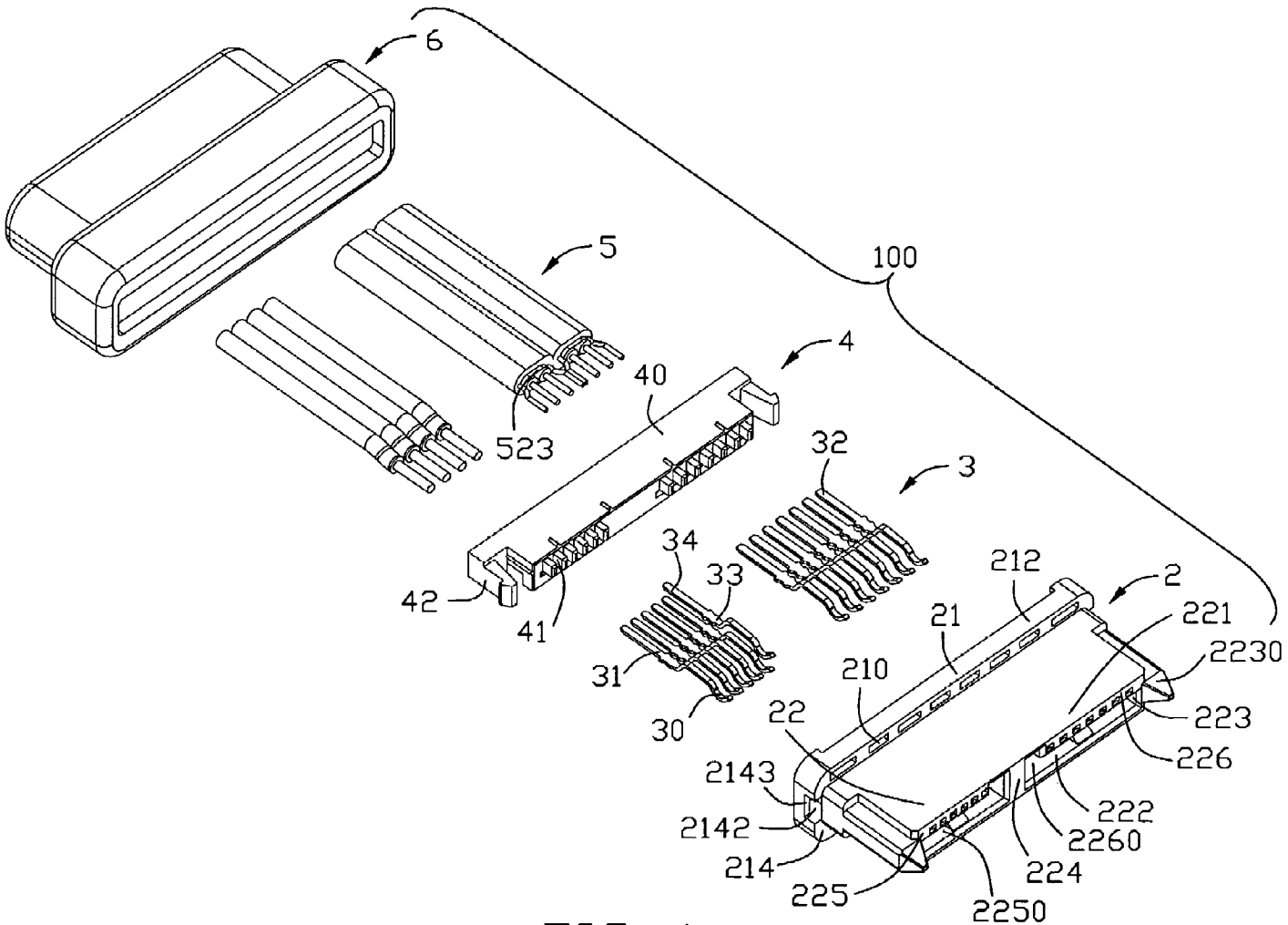
FIG. 1 is an exploded, perspective view of a cable connector assembly in accordance with the present invention.

Reference will now be made to the drawing figures to describe the present invention in detail.

Figure 2:
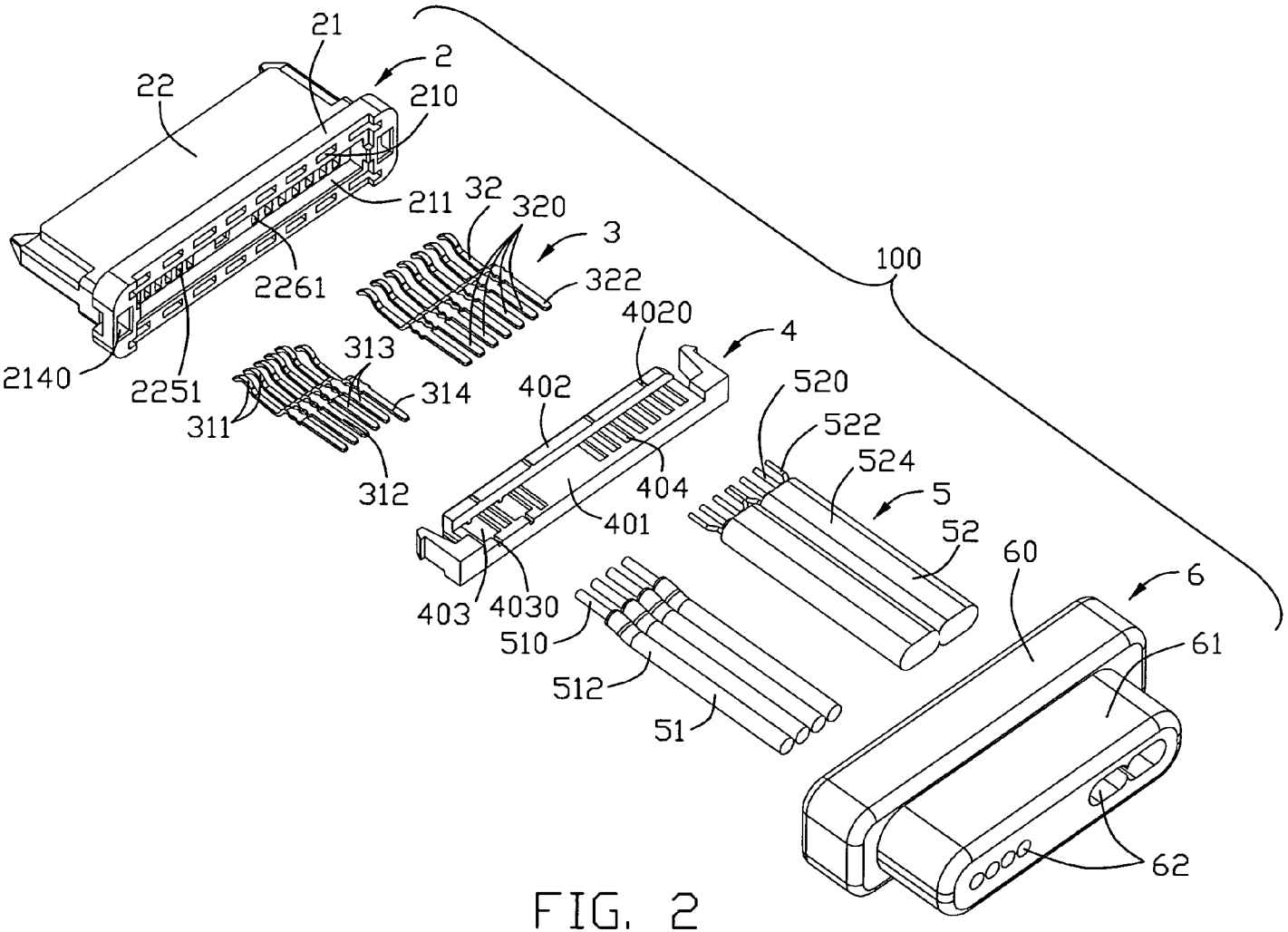
FIG. 2 is a view similar to FIG. 1, but viewed from a different aspect.

Referring to FIGS. 1-2, a cable connector assembly 100 in accordance with the present invention comprises an insulative housing 2, a plurality of contacts 3 housed in the insulative housing 2, a spacer 4 assembled to the insulative housing 2 and the contacts 3, a cable set 5 electrically connecting with the contacts 3 and an outer cover 6 enclosing the conjunctions of the cable set 5 and the contacts 3 and the spacer 4.

Figure 3:
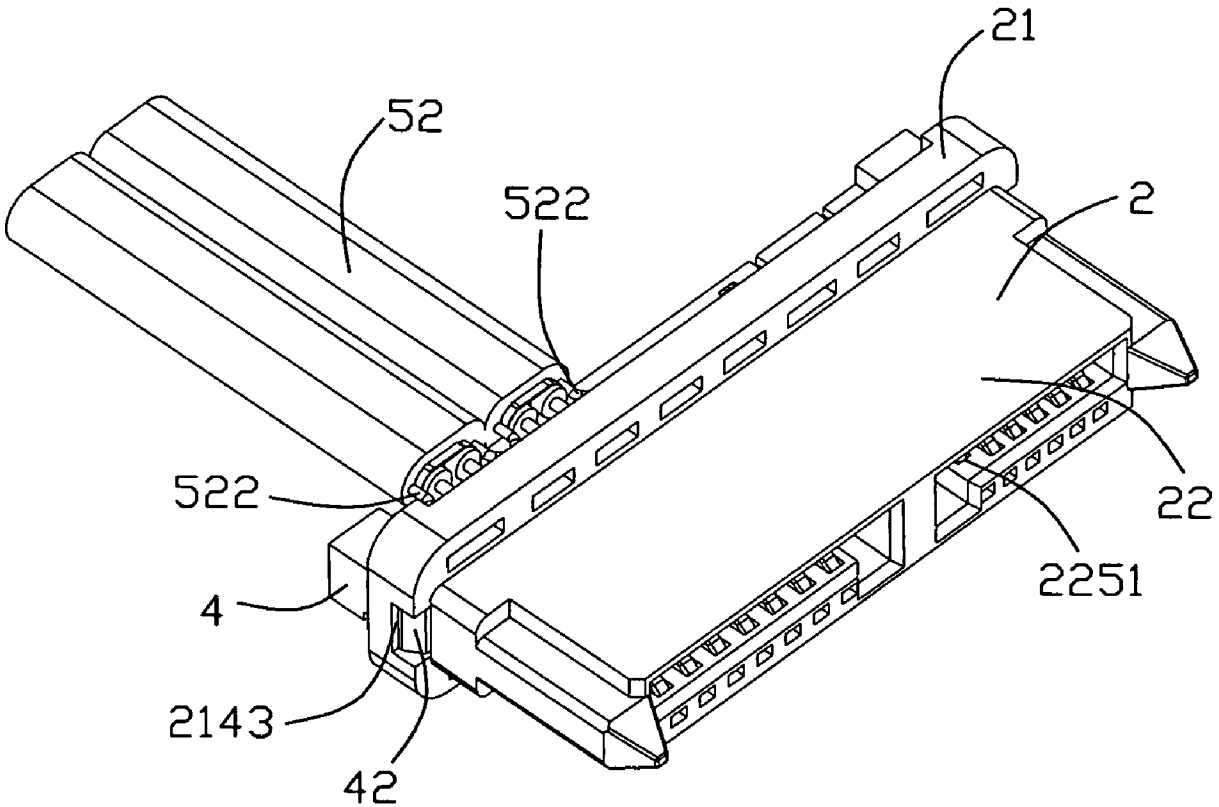
FIGS. 3-5 are partially assembled views of the cable connector assembly viewed from different aspects.
Figure 4:
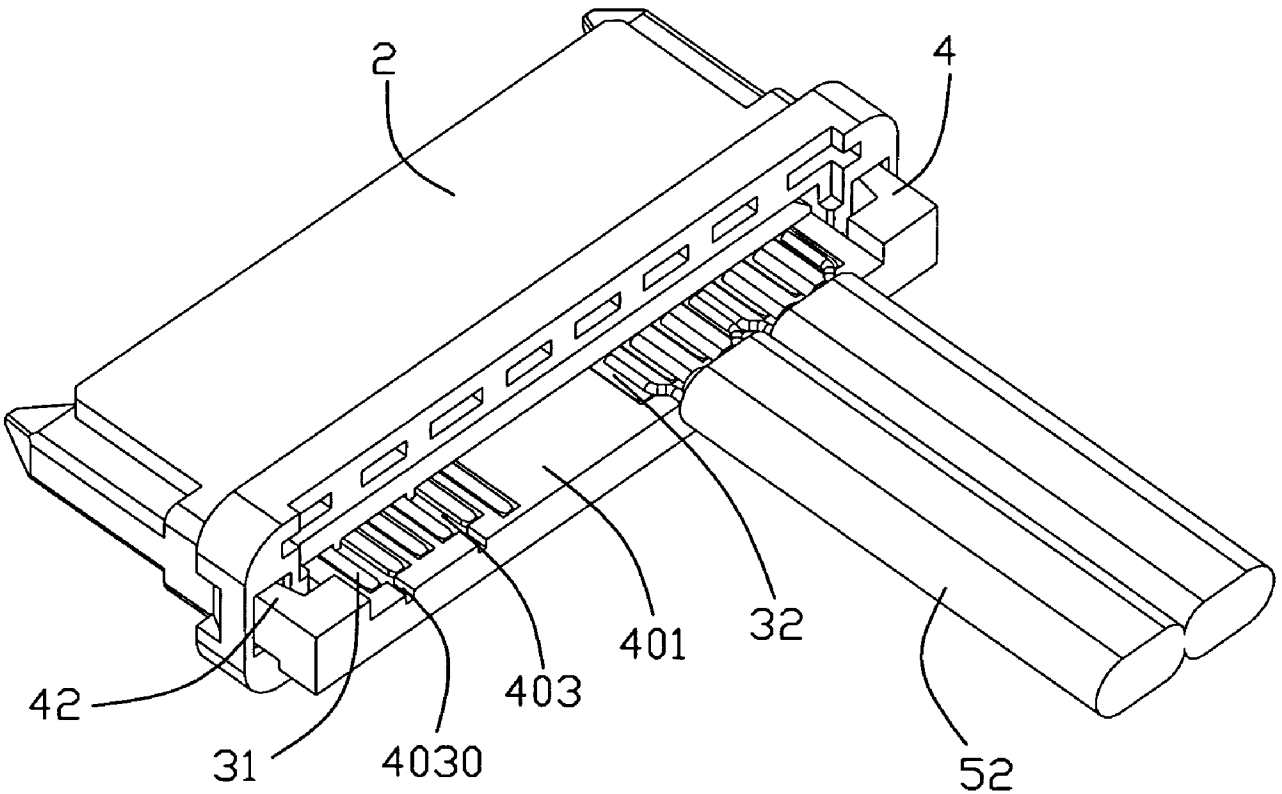
Figure 5:
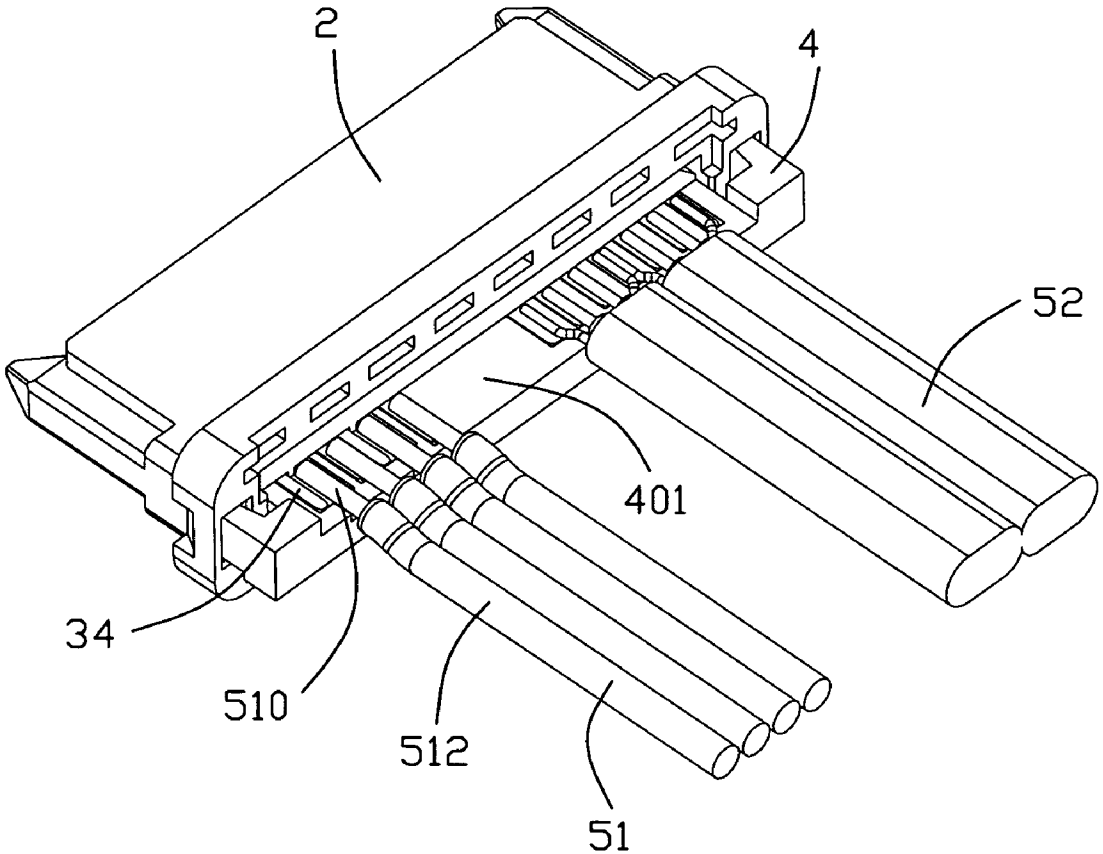
Figure 6:
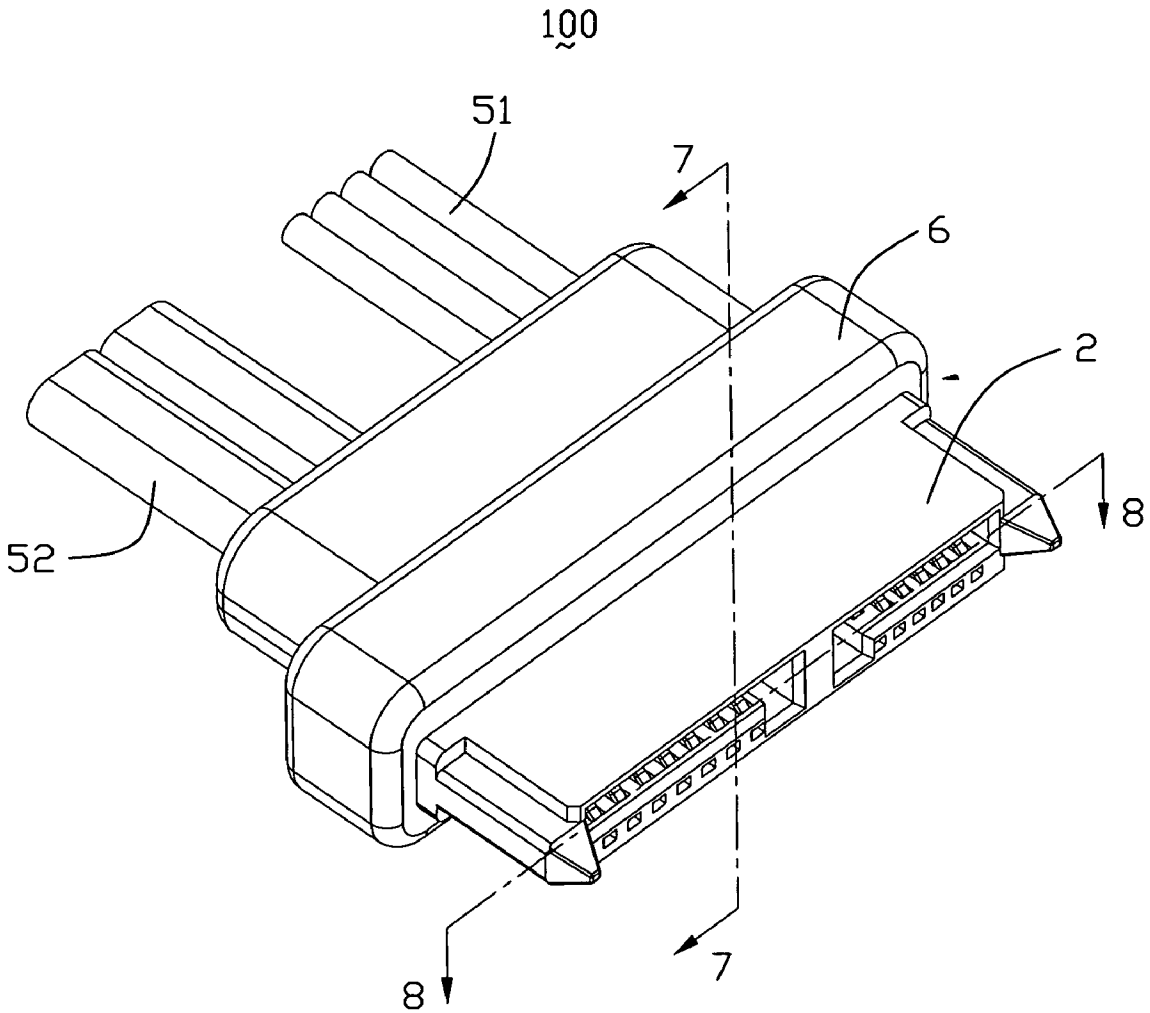
FIG. 6 is an assembled, perspective view of FIG. 1.
Figure 7:
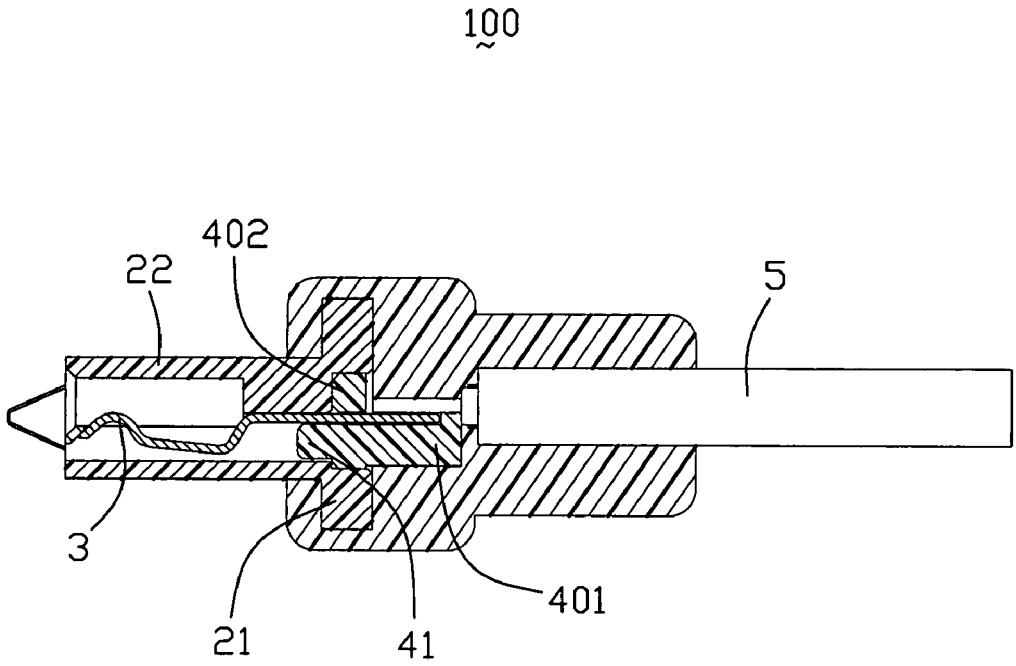
FIGS. 7-8 are cross-section views of the cable connector assembly taken along lines 7-7 and 8-8 of FIG. 6.
Figure 8:
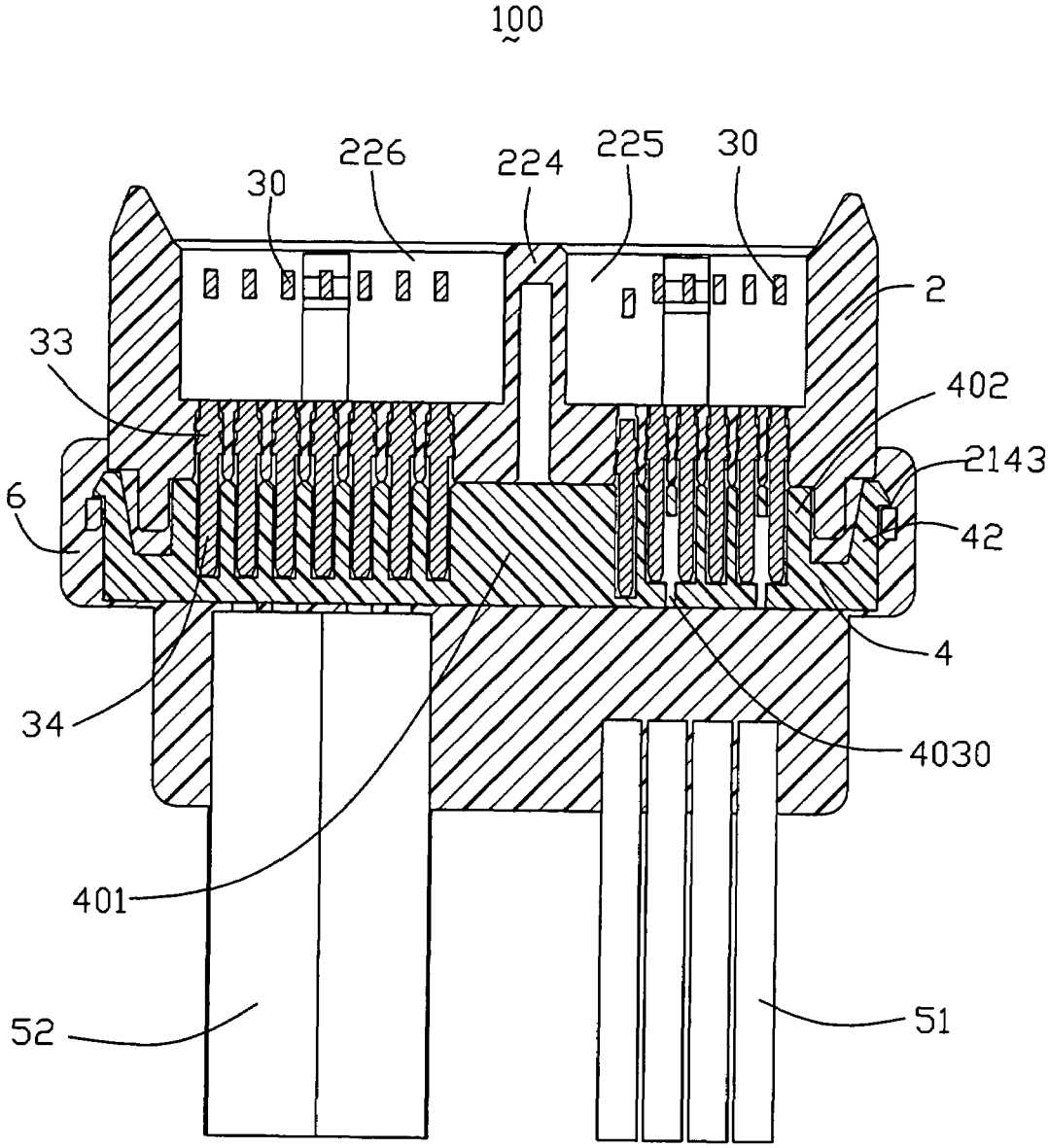

Still to FIGS. 1-2, the insulative housing 2 is elongated and comprises a base portion mainly extending along a lateral direction and having a relatively small thickness along a mating direction and a mating portion 22 extending forwardly from the base portion 21 with a relatively large thickness along the mating direction. The exposed portion of the base portion 21 beyond the mating portion 22 forms opposite upper and lower edges 212 and a pair of end portions 214. A plurality of through slots 210 penetrating through the base portion 21 along the mating direction and are spaced arranged on upper and lower edges 212 of the base portion 21. A recess 211 is recessed forwardly from a rear surface of the mating portion 21. A pair of rectangular channels 2140 respectively extends through the end portions 214 of the base portion 21 along rear-to-front direction, while, a pair of cutouts 2142 are respectively formed to communicate with side surface and front surface of the base portion 21 and corresponding channels 2140, thus, forming a pair of steps 2143. The mating portion 22 comprises a relatively thicker upper wall 221, a relatively thinner lower wall 222 opposite to the upper wall 221 and a pair of sidewalls 223 connecting with the upper and lower walls 221, 222. A partition wall 224 is formed to be parallel to the sidewalls 223 and connects with the upper and lower walls 221, 222. Thus, a first mating segment 225 and a second mating segment 226 side by side are formed by the upper and lower walls 221, 222, the sidewalls 223 and the partition wall 224. The second mating segment 226 is longer than the first mating segment 225 along the lateral direction. Each of the first and second mating segments 225, 226 defines L-shape first and second receiving spaces 2250, 2260 with the second receiving space 2260 is larger than the first receiving space 2250. A plurality of first and second passageways 2251, 2261 are respectively defined through the upper wall 221 to communicate with the recess 211 of the base portion 21 and with the first and second receiving spaces 2250, 2260. The number of the first passageways 2251 is six, while the number of the second passageways 2261 is seven. Particularly referring to FIG. 3, one of the six first passageways 2251 adjacent to the partition wall 224 is shorter than other first passageways 2251, that is to say, other first passageways 2251 locate closer to the front surface of the mating portion 22 than the shorter first passageway 2251. A pair of tapered guiding posts 2230 is formed with the sidewalls 223 to guide the insertion of the cable connector assembly 100 with a complementary connector.

The contacts 3 consist of a set of six first contacts 31 and a set of seven second contacts 32 parallel arranged and having the same structure. Each contact 3 comprises a curved contacting portion 30, a middle retention portion 33 and a flat rear tail portion 34. In addition, the seven second contacts 32 are sued for signal transmission and comprise two pairs of differential pairs 320 for signal transmission and three grounding contacts 322 interlaced with the differential pairs 320 to provide ground function to the signal transmission. The six first contacts 31 comprise a pair of ground contacts 311 adjacent to each other, a first optical contact 312 located adjacent to one of the ground contacts 311, a pair of power contacts 313 with 5 v voltage located adjacent to the first optical contact 312 and a second optical contact 314 located adjacent to one of the power contacts 313. The optical contacts 312, 314 are respectively for Manufacturing Diagnostic (MD) and Device Present (DP).

The spacer 4 is made from insulative material and is elongated. The spacer 4 comprises a T-shape body portion 40, a plurality of protrusions 41 extending forwardly from a front surface of the body portion 40, and a pair of latch portions 42 extending forwardly from rear opposite ends of the body portion 40 with forward latches. The bottom surface of the body portion 40 is partially cut to form a front flange 402 with a plurality of ribs 4020 formed on outer periphery thereof and a rear supporting area 401. The supporting area 401 is slotted with a plurality of first receiving channels 403 and a plurality of second receiving channels 404 respectively aligning with the first and second passageways 2251, 2261 and penetrating through the front flange 402 to align below corresponding protrusions 41. Further, there are two pairs of two adjacent first receiving channels 403 are combined into one relatively large first receiving channel 403. Thus, the first receiving channels 403 totally have four receiving channels, two are large and two are normal, alternatively arranged. In addition, each large first receiving channel 403 has a slit 4030 to communicate with the rear surface of the body portion 40 and locates in a middle of the large first receiving channel 403.

The cable set 5 comprises a set of four single-ended first wires 51 side by side arranged and a second cable 52 in accordance with Serial ATA standard. Each first wire 51 comprises an inner conductor 510 and an outer jacket 512 enclosing the inner conductor 510. The second cable 52 comprises a pair of groups each comprising a pair of signal conductors 520 served as differential pair, a metal braiding layer 523 enclosing the pair of signal conductors 520, and a pair of grounding conductors 522 located at opposite outer sides of the signal conductors 520 to electrically connecting with the metal braiding layer 523. The second cable 52 further comprises an outer jacket 524 enclosing the pair of groups therein.

Please refer to FIGS. 3-8, in assembly, the contacts 3 respectively insert into the insulative housing 2 with the first contacts 31 into the first passageways 2251 and the second contacts 32 into the second passageways 2261. The innermost first contact 31 is received in the shorter first passageway 2251, thus, other first contacts 31 locate closer to the front surface of the mating portion 22 of the housing 2 than the innermost first contact 31. The mating portions 30 of the contacts 3 are partially exposed into the first and second receiving spaces 2250, 2260, the retention portions 33 interferentially engage with the first and passageways 2251, 2261 to retain the contacts 3 in the housing 2, and the tail portions 34 are exposed beyond the passageways 2251, 2261. Then, the spacer 4 is assembled to the insulative housing 2 and the contacts 3. The front flange 402 is interferentially received in the recess 211 of the base portion 21 via the ribs 4020, and the protrusions 41 are inserted into the passageways 2251, 2261 to seal the passageways 2251, 2261 from rear end for preventing the melted material of the cover 6 from entering into the passageways 2251, 2261 to influence the electrical connection. The tail portions 34 of the contacts 3 protrude through corresponding receiving channels 403, 404 below the protrusions 41 and are arranged to be received in the receiving channels 403, 404 in the supporting area 401. The two outermost first contacts 31 and the middle two first contacts 31 are respectively received in the same large first receiving channels 403, while other contacts 3 are respectively received in the receiving channels 403, 404 in one-to-one manner. The pair of latch portions 42 insert through the rectangular channels 2140 with forward latches latching with the steps 2143 to latch the housing 2 with the spacer 4. Further, the innermost first receiving channel 403 locates closer to the rear surface of the spacer 4 than other receiving channels 403, 404 to receive the tail portion 34 of the innermost first contact 31.

The cable set 5 is soldered to the contacts 3 in the supporting area 40 of the spacer 4. Two first wires 51 are soldered to the tail portions 34 of the first contacts 31 in one-to-one manner. The other two first wires 51 are soldered to four tail portions 34 of four first contacts 31, that is to say, in one-to-two manner. The one-to-two first wires 51 are partially received into the slits 4030 to be positioned by the slits 4030 and contact each two tail portions 34 at the same time. The second cable 52 electrically connects with the second contacts 32 with the signal and grounding conductors 520, 522 soldered with the tail portions 34 of the second contacts 32, while the middle two grounding conductors 522 are soldered to the same second contact 32.

Finally, the cover 6 is overmolded with the elements above and forms a front receiving portion 60 to enclose the base portion 21 of the insulative housing 2, the junctions between the cable set 5 and the contacts 3, the spacer 4, and a rear receiving portion 61 to enclose the forward end of the cable set 5 adjacent to the junctions. The melted material of the cover 6 fills up the slots 210 of the insulative housing 2 to enhance the connection with the insulative housing 2. Thus, the cable set 5 exists from the cover 6 through passages 62 of the cover 6.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly adapted for electrically connecting with a complementary connector along a mating direction, comprising:

an insulative housing defining a plurality of passageways along said mating direction;

a plurality of contacts received in the passageways of the insulative housing with tail portions thereof exposed beyond the insulative housing;

a spacer assembled to the insulative housing and the contacts, the spacer defining a plurality of receiving channels to receive the tail portions of the contacts; wherein at least a pair of tail portions of the contacts are received in the same receiving channel of the spacer with other tail portions of the contacts received in the receiving channels of the spacer in one-to-one manner, the spacer further defines at least one slit communicating with said receiving channel receiving said pair of tail portions; and a cable comprising a plurality of conductors respectively electrically connecting with the contacts, and wherein at least one conductor is partially received in the slit to be positioned by the slit and electrically connect with said pair of tail portions of the contacts at the same time.

2. The cable connector as claimed in claim 1, wherein there are two pairs of tail portions of the contacts form two-to-one relationship with the receiving channels of the spacer.

3. The cable connector as claimed in claim 2, wherein one pair of contacts are ground contacts and the other pair of contacts are power contacts, and wherein each pair of contacts connect to the same conductor of the cable.

4. The cable connector assembly as claimed in claim 2, further comprising a first and second optical contacts for optical use and alternatively arranged with the two pairs of contacts.

5. The cable connector assembly as claimed in claim 4, wherein the rear end of the second optical contact locates closer to the rear surface of the insulative housing than other contacts.

6. The cable connector assembly as claimed in claim 1, wherein the spacer comprises a body portion defining the receiving channels and a pair of latch portions at opposite sides of the body portion, and wherein the housing defines a pair of channels at opposite sides thereof to receive the latch portions of the spacer.

7. The cable connector assembly as claimed in claim 1, wherein the spacer comprises a plurality of protrusions extending forwardly from the body portion to be received in the passageways of the housing together with corresponding contacts.

8. The cable connector assembly as claimed in claim 1, wherein said contacts are first contact, and the cable connector assembly further comprises a plurality of second contacts for signal transmission, wherein the housing defines a plurality of second passageways receiving the second contacts, the spacer defines a plurality of second receiving channels to receive the tail portions of the second contacts, and a second cable comprising a plurality of conductors electrically connecting with the tail portions of the second contacts.

9. The cable connector assembly as claimed in claim 8, wherein the first and the second contacts have substantially the same structure and different pitches.

10. The cable connector assembly as claimed in claim 8, wherein the tail portions of the second contacts are received in corresponding second channels in one-to-one manner.

11. The cable connector assembly as claimed in claim 8, wherein the second cable is a standard Serial ATA cable.

12. A cable connector assembly comprising:

an insulative housing comprising a first segment for power and optical use and a second segment for signal transmission and each of the first and the second segments defining a plurality of passageways therethrough;

a plurality of first contacts received in the first segment and a plurality of second contacts received in the second segment with tail portions of the first and the second contacts exposed beyond the insulative housing;

a spacer assembled to the insulative housing and the tail portions of the first and second contacts, the spacer defining a plurality of first receiving channels and a plurality of second receiving channels; and a first cable set and a second cable set each comprising a plurality of conductors respectively electrically connecting with the tail portions of the first and second contacts; and wherein the tail portions of the second contacts are received in the second receiving channels of the spacer in one-to-one manner, while at least a pair of tail portions of the first contacts are received in the same first receiving channel of the spacer and electrically connect to the same conductor of the first cable set.

13. The cable connector as claimed in claim 12, wherein each segment defines an L-shape receiving space communicating with corresponding first and second passageways.

14. The cable connector assembly as claimed in claim 12, wherein two pairs of the first contacts are received in the first receiving channels in two-to-one manner and respectively served as ground and power contacts.

15. The cable connector assembly as claimed in claim 14, wherein other two of the first contacts are for optical use and are alternatively arranged with said two pairs of first contacts, and wherein said two of the first contacts are received in the first receiving channels in one-to-one manner and electrically connecting with the conductors of the first cable set in one-to-one manner.

16. The cable connector assembly as claimed in claim 12, the spacer comprises a pair of latch portions at two opposite sides of the first and second receiving channels to latchably engage with the insulative housing.

17. The cable connector assembly as claimed in claim 12, further comprising a cover enclosing the rear portion of the insulative housing, the conjunctions between the contacts and the cable sets and the spacer.

18. A cable connector assembly comprising:

an insulative housing defining a plurality of passageways extending between opposite front and rear faces thereof;

a plurality of contacts disposed in the corresponding passageways, respectively;

a spacer structure formed behind the rear face;

a plurality of channels formed in a face of the spacer with a partition between every adjacent two channels, and in alignment with the corresponding passageways, respectively, under a condition that at least a pair of adjacent channels are merged together by removing at least a portion of the corresponding partition therebetween; and a plurality of conductors located behind the housing; wherein each of the contacts includes a solder tail received in the corresponding channel, so as to have all the conductors are respectively soldered unto the corresponding solder tails except at least one conductor which is aligned with said removed partition and mechanically and electrically connected to both the two corresponding adjacent solder tails beside.

19. The cable connector assembly as claimed in claim 18, wherein the spacer is discrete from the housing and attached to the housing via at least a latch on one transverse end of the spacer.

20. The cable connector assembly as claimed in claim 18, wherein said spacer defines at least one slit aligned with said at least one conductor to retain said at least one conductor in position without transverse movement.

* * * * *